US007832231B2

(12) United States Patent
Knight et al.

(10) Patent No.: US 7,832,231 B2
(45) Date of Patent: Nov. 16, 2010

(54) MULTICHANNEL EVAPORATOR WITH FLOW SEPARATING MANIFOLD

(75) Inventors: John T. Knight, Wichita, KS (US); Jeffrey Lee Tucker, Wichita, KS (US); Mahesh Valiya-Naduvath, Lutherville, MD (US)

(73) Assignee: Johnson Controls Technology Company, Holland, MI (US)

( * ) Notice: Subject to any disclaimer, the term of this patent is extended or adjusted under 35 U.S.C. 154(b) by 0 days.

(21) Appl. No.: 12/040,559

(22) Filed: Feb. 29, 2008

(65) Prior Publication Data

US 2008/0141707 A1 Jun. 19, 2008

Related U.S. Application Data

(63) Continuation of application No. PCT/US2007/085185, filed on Nov. 20, 2007.

(60) Provisional application No. 60/882,033, filed on Dec. 27, 2006, provisional application No. 60/867,043, filed on Nov. 22, 2006.

(51) Int. Cl.
*F25B 39/04* (2006.01)

(52) U.S. Cl. ..... 62/509; 62/515

(58) Field of Classification Search ..... 62/509, 62/498, 515; 165/148, 151, 153, 173, 176, 165/170, 171, 172, 174, 175
See application file for complete search history.

(56) References Cited

U.S. PATENT DOCUMENTS

| | | | |
|---|---|---|---|
| 3,229,722 | A | 1/1966 | Kritzer |
| 3,603,384 | A | 9/1971 | Huggins et al. |
| 3,636,982 | A | 1/1972 | Drake |
| 3,871,407 | A | 3/1975 | Bykov et al. |
| 4,031,602 | A | 6/1977 | Cunningham et al. |
| 4,190,105 | A | 2/1980 | Dankowski |
| 4,370,868 | A | 2/1983 | Kim |
| 4,766,953 | A | 8/1988 | Grieb et al. |
| 4,971,145 | A | 11/1990 | Lyon |
| 5,076,354 | A | 12/1991 | Nishishita |
| 5,127,154 | A | 7/1992 | Johnson et al. |
| 5,168,925 | A | 12/1992 | Suzumura |

(Continued)

FOREIGN PATENT DOCUMENTS

| | | |
|---|---|---|
| DE | 19740114 | 3/1999 |

(Continued)

OTHER PUBLICATIONS

U.S. Appl. No. 12/040,501, filed Feb. 29, 2008, Tucker et al.

(Continued)

*Primary Examiner*—Mohammad M Ali
(74) *Attorney, Agent, or Firm*—Fletcher Yoder

(57) ABSTRACT

Heating, ventilation, air conditioning, and refrigeration (HVAC&R) systems and heat exchangers are provided which include tube and manifold configurations designed to promote separation of vapor phase and liquid phase fluid. The manifolds contain multichannel tubes of various end geometries designed to dispose flow channels at different heights within the manifold. Individual tubes also may be disposed at different heights within the manifold. The various flow channel and tube heights permit direction of vapor phase and liquid phase refrigerant to certain flow channels.

18 Claims, 4 Drawing Sheets

U.S. PATENT DOCUMENTS

| | | | | |
|---|---|---|---|---|
| 5,174,373 | A | 12/1992 | Shinmura | |
| 5,186,248 | A | 2/1993 | Halstead | |
| 5,186,249 | A | 2/1993 | Bhatti et al. | |
| 5,251,682 | A | 10/1993 | Haussmann | |
| 5,327,959 | A | 7/1994 | Saperstein | |
| 5,372,188 | A | 12/1994 | Dudley | |
| 5,448,899 | A | 9/1995 | Ohara | |
| 5,479,784 | A | 1/1996 | Dobmeier | |
| 5,560,426 | A * | 10/1996 | Trahan et al. | 166/120 |
| 5,586,598 | A | 12/1996 | Tanaka et al. | |
| 5,797,184 | A | 8/1998 | Tanaka et al. | |
| 5,826,646 | A | 10/1998 | Bae | |
| 5,836,382 | A | 11/1998 | Dingle | |
| 5,901,782 | A | 5/1999 | Voss | |
| 5,901,785 | A | 5/1999 | Chiba | |
| 5,910,167 | A | 6/1999 | Reinke | |
| 5,934,367 | A | 8/1999 | Shimmura | |
| 5,941,303 | A | 8/1999 | Gowan et al. | |
| 5,967,228 | A | 10/1999 | Bergman | |
| 6,116,335 | A | 9/2000 | Beamer et al. | |
| 6,148,635 | A | 11/2000 | Beebe | |
| 6,155,075 | A | 12/2000 | Hanson | |
| 6,199,401 | B1 | 3/2001 | Haussmann | |
| 6,237,677 | B1 | 5/2001 | Kent et al. | |
| 6,449,979 | B1 | 9/2002 | Nagasawa | |
| 6,502,413 | B2 | 1/2003 | Repice | |
| 6,688,137 | B1 | 2/2004 | Gupte | |
| 6,814,136 | B2 | 11/2004 | Yi | |
| 6,827,128 | B2 | 12/2004 | Philpott | |
| 6,868,696 | B2 | 3/2005 | Ikuta | |
| 6,886,349 | B1 | 5/2005 | Curicuta | |
| 6,892,802 | B2 | 5/2005 | Kelly | |
| 6,904,770 | B2 | 6/2005 | Telesz et al. | |
| 6,904,966 | B2 | 6/2005 | Philpott | |
| 6,912,864 | B2 | 7/2005 | Roche | |
| 6,932,153 | B2 | 8/2005 | Ko | |
| 6,964,296 | B2 | 11/2005 | Memory | |
| 6,988,538 | B2 | 1/2006 | Merkys | |
| 7,000,415 | B2 | 2/2006 | Daddis | |
| 7,003,971 | B2 | 2/2006 | Kester | |
| 7,004,239 | B2 * | 2/2006 | Osakabe et al. | 165/104.21 |
| 7,021,370 | B2 | 4/2006 | Papapanu | |
| 7,028,483 | B2 | 4/2006 | Mansour | |
| 7,044,200 | B2 | 5/2006 | Gupte | |
| 7,066,243 | B2 | 6/2006 | Horiuchi | |
| 7,080,526 | B2 | 7/2006 | Papapanu | |
| 7,107,787 | B2 | 9/2006 | Inaba | |
| 7,143,605 | B2 | 12/2006 | Rohrer | |
| 7,152,669 | B2 | 12/2006 | Kroetsch et al. | |
| 7,163,052 | B2 | 1/2007 | Taras | |
| 7,201,015 | B2 | 4/2007 | Feldman | |
| 7,219,511 | B2 | 5/2007 | Inaba | |
| 7,222,501 | B2 | 5/2007 | Cho | |
| 7,237,406 | B2 * | 7/2007 | Voss et al. | 62/606 |
| 2004/0134226 | A1 | 7/2004 | Kraay | |
| 2004/0261983 | A1 | 12/2004 | Halstead | |
| 2005/0056049 | A1 | 3/2005 | Sanada | |
| 2005/0217831 | A1 | 10/2005 | Manaka | |
| 2005/0241816 | A1 | 11/2005 | Shabtay et al. | |
| 2005/0268069 | A1 | 12/2005 | Hancock | |
| 2006/0101849 | A1 | 5/2006 | Taras et al. | |
| 2006/0102332 | A1 | 5/2006 | Taras | |
| 2006/0130517 | A1 | 6/2006 | Merkys | |
| 2006/0131009 | A1 * | 6/2006 | Nies | 165/176 |
| 2007/0039724 | A1 | 2/2007 | Trumbower | |
| 2008/0023183 | A1 | 1/2008 | Beamer et al. | |
| 2008/0023184 | A1 | 1/2008 | Beamer et al. | |
| 2008/0023185 | A1 | 1/2008 | Beamer et al. | |
| 2008/0023186 | A1 | 1/2008 | Beamer et al. | |
| 2008/0060199 | A1 | 3/2008 | Fuller et al. | |
| 2008/0078541 | A1 | 4/2008 | Beamer et al. | |
| 2008/0092587 | A1 | 4/2008 | Gorbounov et al. | |
| 2008/0093051 | A1 | 4/2008 | Rios et al. | |
| 2008/0093062 | A1 | 4/2008 | Gorbounov et al. | |

FOREIGN PATENT DOCUMENTS

| | | |
|---|---|---|
| EP | 0219974 | 4/1987 |
| EP | 0583851 | 2/1994 |
| EP | 0851188 | 7/1998 |
| FR | 2664371 | 7/1990 |
| JP | 56130595 | 10/1981 |
| JP | 58045495 | 3/1983 |
| JP | 04069228 | 3/1992 |
| JP | 04186070 | 6/1992 |
| JP | 07190661 | 7/1995 |
| JP | 10062092 | 3/1998 |
| JP | 11083371 | 3/1999 |
| WO | WO 02103263 | 12/2001 |
| WO | WO02/103270 | 12/2002 |
| WO | WO2006/083426 | 8/2006 |
| WO | WO2006/083435 | 8/2006 |
| WO | WO2006/083441 | 8/2006 |
| WO | WO 2006/083442 | 8/2006 |
| WO | WO 2006/083443 | 8/2006 |
| WO | WO 2006/083445 | 8/2006 |
| WO | WO 2006/083446 | 8/2006 |
| WO | WO 2006/083447 | 8/2006 |
| WO | WO 2006/083448 | 8/2006 |
| WO | WO 2006/083449 | 8/2006 |
| WO | WO 2006/083450 | 8/2006 |
| WO | WO 2006/083451 | 8/2006 |
| WO | WO 2006/083484 | 8/2006 |
| WO | WO 2006083445 | 8/2006 |

OTHER PUBLICATIONS

U.S. Appl. No. 12/040,588, filed Feb. 29, 2008, Valiya-Naduvath et al.
U.S. Appl. No. 12/040,612, filed Feb. 29, 2008, Yanik et al.
U.S. Appl. No. 12/040,661, filed Feb. 29, 2008, Yanik et al.
U.S. Appl. No. 12/040,697, filed Feb. 29, 2008, Yanik et al.
U.S. Appl. No. 12/040,724, filed Feb. 29, 2008, Obosu et al.
U.S. Appl. No. 12/040,743, filed Feb. 29, 2008, Breiding et al.
U.S. Appl. No. 12/040,764, filed Feb. 29, 2008, Knight.

* cited by examiner

FIG. 1
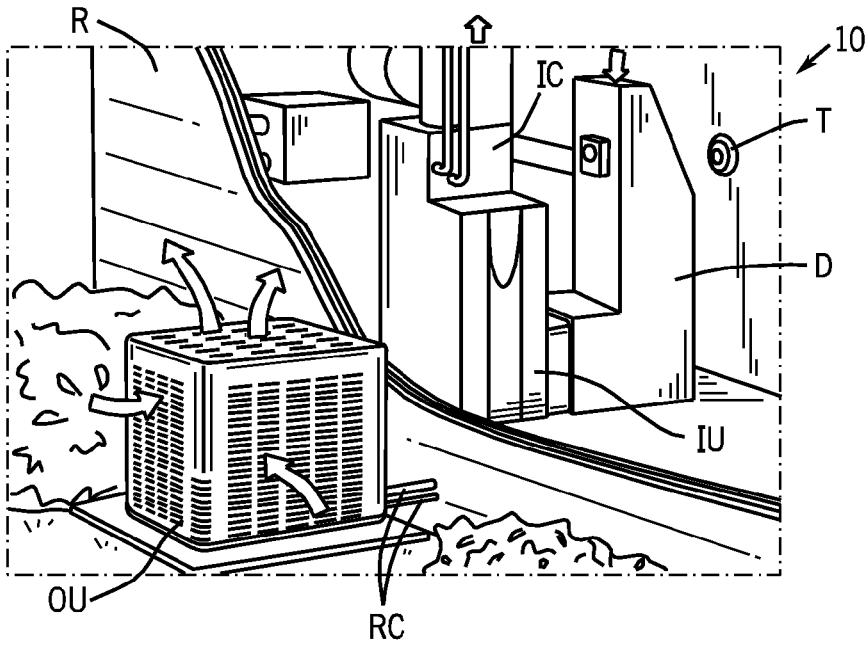
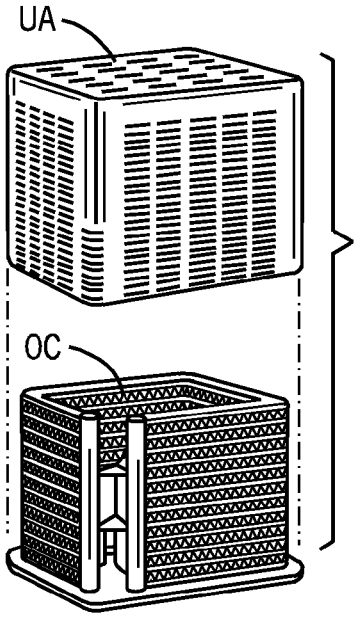
FIG. 2
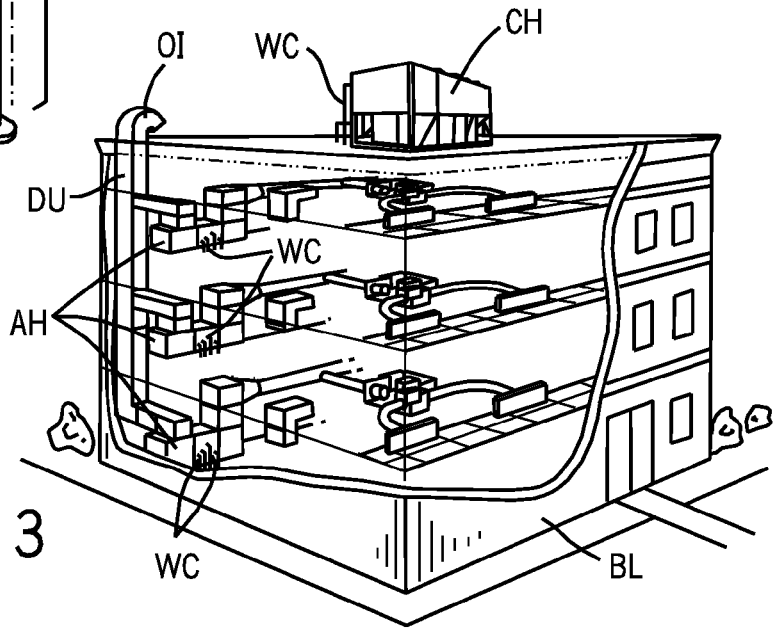
FIG. 3

FIG. 10
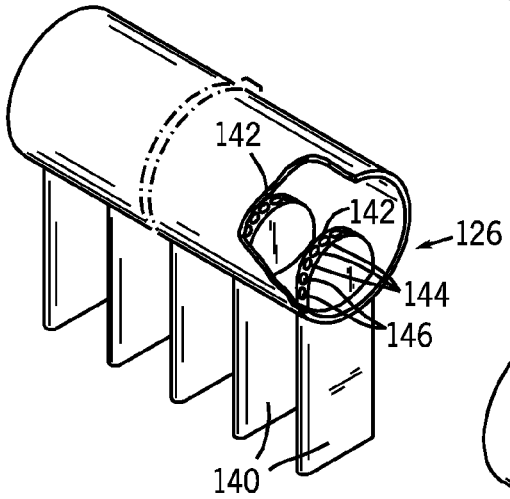
FIG. 9
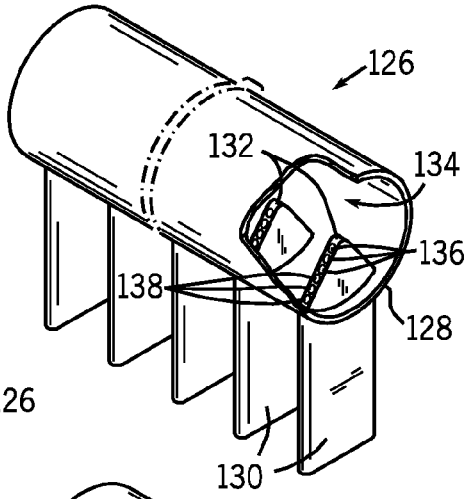
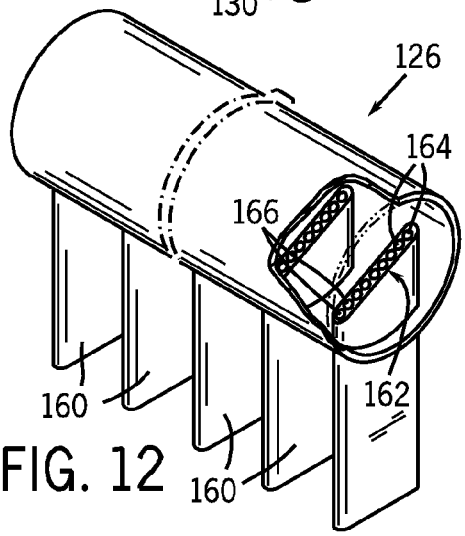
FIG. 12
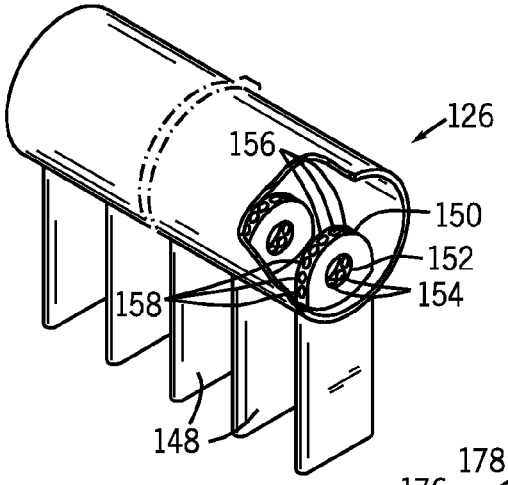
FIG. 11
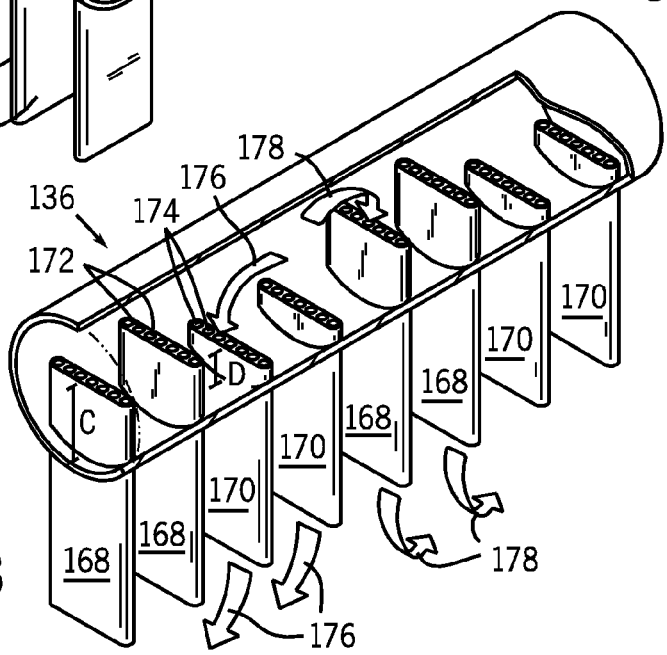
FIG. 13

MULTICHANNEL EVAPORATOR WITH FLOW SEPARATING MANIFOLD

CROSS REFERENCE TO RELATED APPLICATIONS

This application claims priority from and the benefit of U.S. Provisional Application Ser. No. 60/867,043, entitled MICROCHANNEL HEAT EXCHANGER APPLICATIONS, filed Nov. 22, 2006, and U.S. Provisional Application Ser. No. 60/882,033, entitled MICROCHANNEL HEAT EXCHANGER APPLICATIONS, filed Dec. 27, 2006, which are hereby incorporated by reference.

BACKGROUND

The invention relates generally to multichannel evaporators with flow separating manifolds.

Heat exchangers are used in heating, ventilation, air conditioning, and refrigeration (HVAC&R) systems. Multichannel heat exchangers generally include multichannel tubes for flowing refrigerant through the heat exchanger. Each multichannel tube may contain several individual flow channels. Fins may be positioned between the tubes to facilitate heat transfer between refrigerant contained within the tube flow channels and external air passing over the tubes. Multichannel heat exchangers may be used in small tonnage systems, such as residential systems, or in large tonnage systems, such as industrial chiller systems.

In general, heat exchangers transfer heat by circulating a refrigerant through a cycle of evaporation and condensation. In many systems, the refrigerant changes phases while flowing through heat exchangers in which evaporation and condensation occur. For example, the refrigerant may enter an evaporator heat exchanger as a liquid and exit as a vapor. In another example, the refrigerant may enter a condenser heat exchanger as a vapor and exit as a liquid. Typically, a portion of the heat transfer is achieved from the phase change that occurs within the heat exchangers. That is, while some energy is transferred to and from the refrigerant by changes in the temperature of the fluid (i.e., sensible heat), much more energy is exchanged by phase changes (i.e., latent heat). For example, in the case of an evaporator, the external air is cooled when the liquid refrigerant flowing through the heat exchanger absorbs heat from the air causing the liquid refrigerant to change to a vapor. Therefore, it is generally preferred for the refrigerant entering an evaporator to contain as much liquid as possible to maximize the heat transfer. If the refrigerant enters an evaporator as a vapor, heat absorbed by the refrigerant will be sensible heat only, reducing the overall heat absorption of the unit that would otherwise be available if a phase change were to take place.

In general, an expansion device is located in a closed loop prior to the evaporator. The expansion device lowers the temperature and pressure of the refrigerant by increasing its volume. However, during the expansion process, some of the liquid refrigerant may be expanded to vapor. Therefore, a mixture of liquid and vapor refrigerant typically enters the evaporator. Because the vapor refrigerant has a lower density than the liquid refrigerant, the vapor refrigerant tends to separate from the liquid refrigerant resulting in some tubes receiving all vapor and no liquid. The tubes containing primarily vapor are not able to absorb much heat, which may result in inefficient heat transfer.

SUMMARY

In accordance with aspects of the invention, a heat exchanger and a system including a heat exchanger are presented. The heat exchanger includes a first manifold configured to receive a mixed phase flow of liquid and vapor. The mixed phase flow partially separates in the first manifold to form a pool of liquid. The heat exchanger also includes a second manifold and a plurality of multichannel tubes in fluid communication with the manifolds. The multichannel tubes include a plurality of flow paths that extend into the first manifold to direct liquid phase flow from the pool through some of the flow paths and vapor phase flow from a region above the pool through other flow paths.

In accordance with further aspects of the invention, a heat exchanger is presented that includes a first manifold configured to receive a mixed phase flow of liquid and vapor. The mixed phase flow partially separates in the first manifold to form a pool of liquid. The heat exchanger also includes a second manifold and a plurality of multichannel tubes in fluid communication with the manifolds. The multichannel tubes include a plurality of flow paths. At least one of the multichannel tubes has an end that extends into the first manifold to position all flow path inlets below a surface of the pool to receive liquid phase flow, and at least another of the multichannel tubes has an end that extends into the first manifold to position all flow path inlets above the surface of the pool to receive only vapor phase flow.

DRAWINGS

FIG. 1 is a perspective view of an exemplary residential air conditioning or heat pump system of the type that might employ a heat exchanger.

FIG. 2 is a partially exploded view of the outside unit of the system of FIG. 1, with an upper assembly lifted to expose certain of the system components, including a heat exchanger.

FIG. 3 is a perspective view of an exemplary commercial or industrial HVAC&R system that employs a chiller and air handlers to cool a building and that may employ heat exchangers.

FIG. 9 is a detail perspective view of an alternate exemplary manifold for use in the heat exchanger of FIG. 6.

FIG. 10 is a detail perspective view illustrating an alternate tube configuration for the exemplary manifold of FIG. 9.

FIG. 11 is a detail perspective view illustrating another alternate tube configuration for the exemplary manifold of FIG. 9.

FIG. 12 is a detail perspective view illustrating yet another alternate tube configuration for the exemplary manifold of FIG. 9.

FIG. 13 is a detail perspective view illustrating a final alternate tube configuration for the exemplary manifold of FIG. 9.

DETAILED DESCRIPTION

Figure 4:
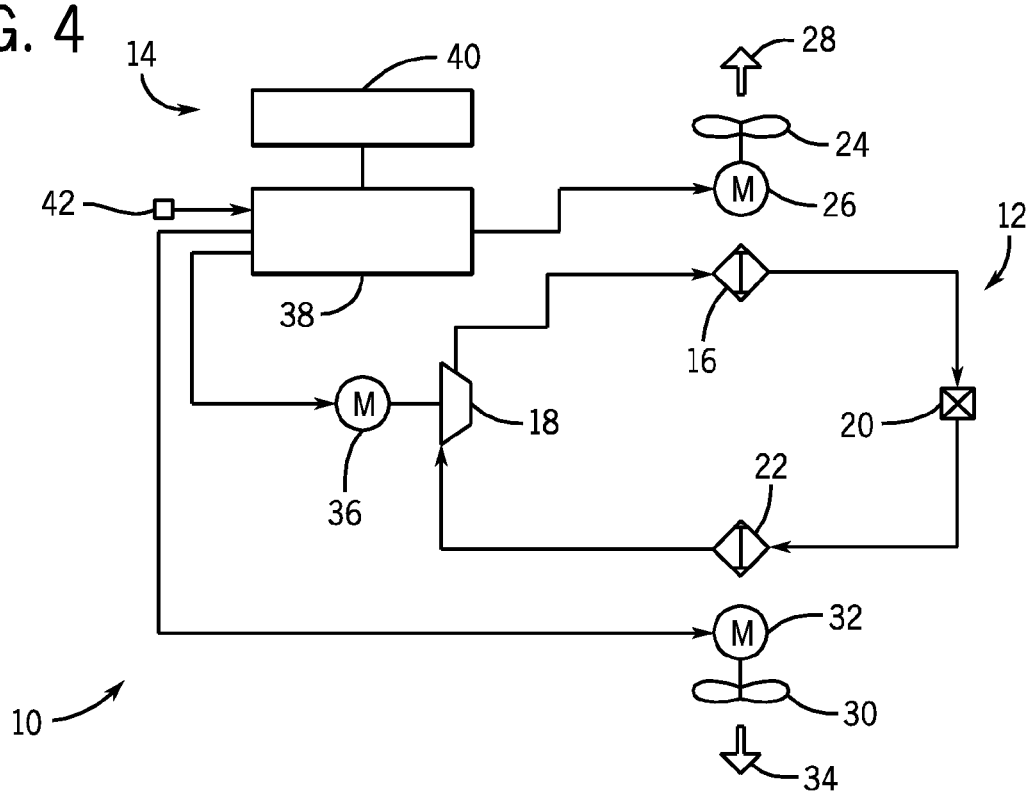
FIG. 4 is a diagrammatical overview of an exemplary air conditioning system, which may employ one or more heat exchangers with tube and manifold configurations.

FIGS. 1-3 depict exemplary applications for heat exchangers. Such systems, in general, may be applied in a range of settings, both within the HVAC&R field and outside of that field. In presently contemplated applications, however, the heat exchanges may be used in residential, commercial, light industrial, industrial and in any other application for heating or cooling a volume or enclosure, such as a residence, building, structure, and so forth. Moreover, the heat exchanges may be used in industrial applications, where appropriate, for basic refrigeration and heating of various fluids. FIG. 1 illustrates a residential heating and cooling system. In general, a residence, designated by the letter R, will be equipped with an outdoor unit OU that is operatively coupled to an indoor unit IU. The outdoor unit is typically situated adjacent to a side of the residence and is covered by a shroud to protect the system components and to prevent leaves and other contaminants from entering the unit. The indoor unit may be positioned in a utility room, an attic, a basement, and so forth. The outdoor unit is coupled to the indoor unit by refrigerant conduits RC that transfer primarily liquid refrigerant in one direction and primarily vaporized refrigerant in an opposite direction.

When the system shown in FIG. 1 is operating as an air conditioner, a coil in outdoor unit OU serves as a condenser for recondensing vaporized refrigerant flowing from indoor unit IU to outdoor unit OU via one of the refrigerant conduits. In these applications, a coil of the indoor unit, designated by the reference characters IC, serves as an evaporator coil. The evaporator coil receives liquid refrigerant (which may be expanded by an expansion device described below) and evaporates the refrigerant before returning it to the outdoor unit.

Outdoor unit OU draws in environmental air through sides as indicated by the arrows directed to the sides of unit OU, forces the air through the outer unit coil by a means of a fan (not shown) and expels the air as indicated by the arrows above the outdoor unit. When operating as an air conditioner, the air is heated by the condenser coil within the outdoor unit and exits the top of the unit at a temperature higher than it entered the sides. Air is blown over the indoor coil IC, and is then circulated through the residence by means of ductwork D, as indicated by the arrows in FIG. 1. The overall system operates to maintain a desired temperature as set by a thermostat T. When the temperature sensed inside the residence is higher than the set point on the thermostat (plus a small amount), the air conditioner will become operative to refrigerate additional air for circulation through the residence. When the temperature reaches the set point (minus a small amount), the unit will stop the refrigeration cycle temporarily.

When the unit in FIG. 1 operates as a heat pump, the roles of the coils are simply reversed. That is, the coil of the outdoor unit will serve as an evaporator to evaporate refrigerant and thereby cool air entering the outdoor unit as the air passes over the outdoor unit coil. Indoor coil IC will receive a stream of air blown over it and will heat the air by condensing a refrigerant.

FIG. 2 illustrates a partially exploded view of one of the units shown in FIG. 1, in this case outdoor unit OU. In general, the unit may be thought of as including an upper assembly UA made up of a shroud, a fan assembly, a fan drive motor, and so forth. The fan and fan drive motor are not visible because they are hidden by the surrounding shroud. An outdoor coil OC is housed within this shroud and is generally deposed to surround or at least partially surround other system components, such as a compressor, an expansion device, a control circuit.

FIG. 3 illustrates another exemplary application, in this case an HVAC&R system for building environmental management. A building BL is cooled by a system that includes a chiller CH, which is typically disposed on or near the building, or in an equipment room or basement. The chiller CH is an air-cooled device that implements a refrigeration cycle to cool water. The water is circulated to a building through water conduits WC. The water conduits are routed to air handlers AH at individual floors or sections of the building. The air handlers are also coupled to duct work DU that is adapted to blow air from an outside intake OI.

Chiller CH, which includes heat exchangers for both evaporating and condensing a refrigerant, cools water that is circulated to the air handlers. Air blown over additional coils that receive the water in the air handlers causes the water to increase in temperature and the circulated air to decrease in temperature. The cooled air is then routed to various locations in the building via additional ductwork. Ultimately, distribution of the air is routed to diffusers that deliver the cooled air to offices, apartments, hallways, and any other interior spaces within the building. In many applications, thermostats or other command devices (not shown in FIG. 3) will serve to control the flow of air through and from the individual air handlers and ductwork to maintain desired temperatures at various locations in the structure.

FIG. 4 illustrates an air conditioning system 10, which uses multichannel tubes. Refrigerant flows through the system within closed refrigeration loop 12. The refrigerant may be any fluid that absorbs and extracts heat. For example, the refrigerant may be hydrofluorocarbon (HFC) based R-410A, R-407, or R-134a, or it may be carbon dioxide (R-744a) or ammonia (R-717). Air conditioning system 10 includes control devices 14 that enable system 10 to cool an environment to a prescribed temperature.

System 10 cools an environment by cycling refrigerant within closed refrigeration loop 12 through condenser 16, compressor 18, expansion device 20, and evaporator 22. The refrigerant enters condenser 16 as a high pressure and temperature vapor and flows through the multichannel tubes of condenser 16. A fan 24, which is driven by a motor 26, draws air across the multichannel tubes. The fan may push or pull air across the tubes. Heat transfers from the refrigerant vapor to the air producing heated air 28 and causing the refrigerant vapor to condense into a liquid. The liquid refrigerant then flows into an expansion device 20 where the refrigerant expands to become a low pressure and temperature liquid. Typically, expansion device 20 will be a thermal expansion valve (TXV); however, in other embodiments, the expansion device may be an orifice or a capillary tube. As those skilled in the art will appreciate, after the refrigerant exits the expansion device, some vapor refrigerant may be present in addition to the liquid refrigerant.

From expansion device 20, the refrigerant enters evaporator 22 and flows through the evaporator multichannel tubes. A fan 30, which is driven by a motor 32, draws air across the multichannel tubes. Heat transfers from the air to the refrigerant liquid producing cooled air 34 and causing the refrigerant liquid to boil into a vapor. In some embodiments, the fan may be replaced by a pump that draws fluid across the multichannel tubes.

The refrigerant then flows to compressor 18 as a low pressure and temperature vapor. Compressor 18 reduces the volume available for the refrigerant vapor, consequently, increasing the pressure and temperature of the vapor refrigerant. The compressor may be any suitable compressor such as a screw compressor, reciprocating compressor, rotary compressor, swing link compressor, scroll compressor, or turbine compressor. Compressor 18 is driven by a motor 36, which receives power from a variable speed drive (VSD) or a direct AC or DC power source. In one embodiment, motor 36 receives fixed line voltage and frequency from an AC power source although in some applications the motor may be driven by a variable voltage or frequency drive. The motor may be a switched reluctance (SR) motor, an induction motor, an electronically commutated permanent magnet motor (ECM), or any other suitable motor type. The refrigerant exits compressor 18 as a high temperature and pressure vapor that is ready to enter the condenser and begin the refrigeration cycle again.

The operation of the refrigeration cycle is governed by control devices 14 that include control circuitry 38, an input device 40, and a temperature sensor 42. Control circuitry 38 is coupled to motors 26, 32, and 36 that drive condenser fan 24, evaporator fan 30, and compressor 18, respectively. The control circuitry uses information received from input device 40 and sensor 42 to determine when to operate the motors 26, 32, and 36 that drive the air conditioning system. In some applications, the input device may be a conventional thermostat. However, the input device is not limited to thermostats, and more generally, any source of a fixed or changing set point may be employed. These may include local or remote command devices, computer systems and processors, mechanical, electrical and electromechanical devices that manually or automatically set a temperature-related signal that the system receives. For example, in a residential air conditioning system, the input device may be a programmable 24-volt thermostat that provides a temperature set point to the control circuitry. Sensor 42 determines the ambient air temperature and provides the temperature to control circuitry 38. Control circuitry 38 then compares the temperature received from the sensor to the temperature set point received from the input device. If the temperature is higher than the set point, control circuitry 38 may turn on motors 26, 32, and 36 to run air conditioning system 10. The control circuitry may execute hardware or software control algorithms to regulate the air conditioning system. In some embodiments, the control circuitry may include an analog to digital (A/D) converter, a microprocessor, a non-volatile memory, and an interface board. Other devices may, of course, be included in the system, such as additional pressure and/or temperature transducers or switches that sense temperatures and pressures of the refrigerant, the heat exchangers, the inlet and outlet air, and so forth.

Figure 5:
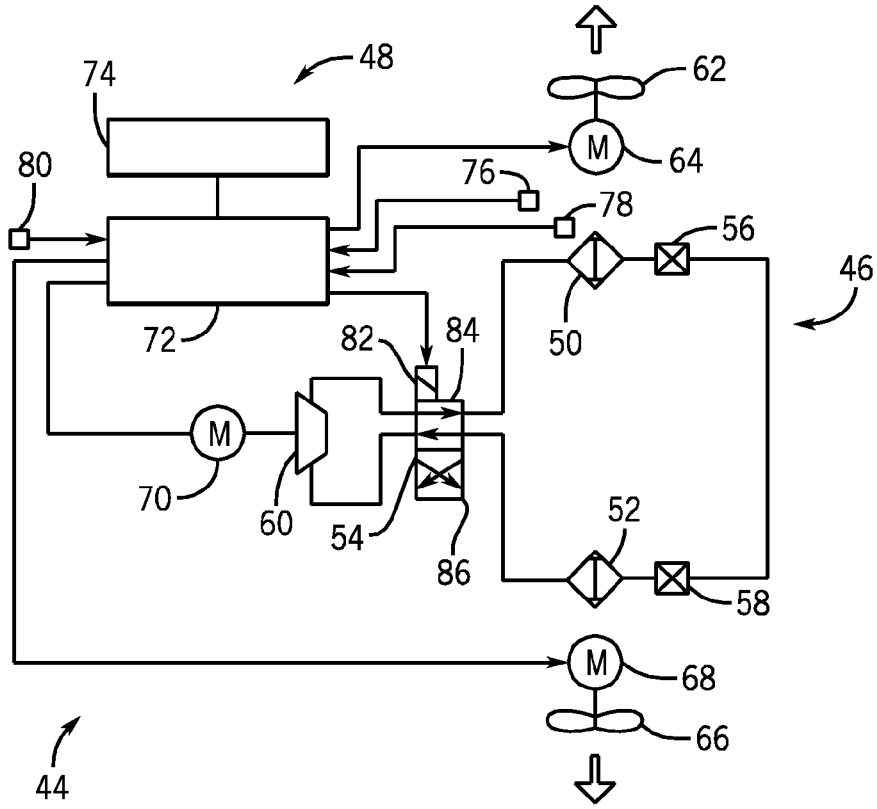
FIG. 5 is a diagrammatical overview of an exemplary heat pump system, which may employ one or more heat exchangers with tube and manifold configurations.

FIG. 5 illustrates a heat pump system 44 that uses multichannel tubes. Because the heat pump may be used for both heating and cooling, refrigerant flows through a reversible refrigeration/heating loop 46. The refrigerant may be any fluid that absorbs and extracts heat. The heating and cooling operations are regulated by control devices 48.

Heat pump system 44 includes an outside coil 50 and an inside coil 52 that both operate as heat exchangers. The coils may function either as an evaporator or as a condenser depending on the heat pump operation mode. For example, when heat pump system 44 is operating in cooling (or "AC") mode, outside coil 50 functions as a condenser, releasing heat to the outside air, while inside coil 52 functions as an evaporator, absorbing heat from the inside air. When heat pump system 44 is operating in heating mode, outside coil 50 functions as an evaporator, absorbing heat from the outside air, while inside coil 52 functions as a condenser, releasing heat to the inside air. A reversing valve 54 is positioned on reversible loop 46 between the coils to control the direction of refrigerant flow and thereby to switch the heat pump between heating mode and cooling mode.

Heat pump system 44 also includes two metering devices 56 and 58 for decreasing the pressure and temperature of the refrigerant before it enters the evaporator. The metering device also acts to regulate refrigerant flow into the evaporator so that the amount of refrigerant entering the evaporator equals the amount of refrigerant exiting the evaporator. The metering device used depends on the heat pump operation mode. For example, when heat pump system 44 is operating in cooling mode, refrigerant bypasses metering device 56 and flows through metering device 58 before entering the inside coil 52, which acts as an evaporator. In another example, when heat pump system 44 is operating in heating mode, refrigerant bypasses metering device 58 and flows through metering device 56 before entering outside coil 50, which acts as an evaporator. In other embodiments, a single metering device may be used for both heating mode and cooling mode. The metering devices typically are thermal expansion valves (TXV), but also may be orifices or capillary tubes.

The refrigerant enters the evaporator, which is outside coil 50 in heating mode and inside coil 52 in cooling mode, as a low temperature and pressure liquid. Some vapor refrigerant also may be present as a result of the expansion process that occurs in metering device 56 or 58. The refrigerant flows through multichannel tubes in the evaporator and absorbs heat from the air changing the refrigerant into a vapor. In cooling mode, the indoor air passing over the multichannel tubes also may be dehumidified. The moisture from the air may condense on the outer surface of the multichannel tubes and consequently be removed from the air.

After exiting the evaporator, the refrigerant passes through reversing valve 54 and into compressor 60. Compressor 60 decreases the volume of the refrigerant vapor, thereby, increasing the temperature and pressure of the vapor. The compressor may be any suitable compressor such as a screw compressor, reciprocating compressor, rotary compressor, swing link compressor, scroll compressor, or turbine compressor.

From the compressor, the increased temperature and pressure vapor refrigerant flows into a condenser, the location of which is determined by the heat pump mode. In cooling mode, the refrigerant flows into outside coil 50 (acting as a condenser). A fan 62, which is powered by a motor 64, draws air over the multichannel tubes containing refrigerant vapor. In some embodiments, the fan may be replaced by a pump that draws fluid across the multichannel tubes. The heat from the refrigerant is transferred to the outside air causing the refrigerant to condense into a liquid. In heating mode, the refrigerant flows into inside coil 52 (acting as a condenser). A fan 66, which is powered by a motor 68, draws air over the multichannel tubes containing refrigerant vapor. The heat from the refrigerant is transferred to the inside air causing the refrigerant to condense into a liquid.

After exiting the condenser, the refrigerant flows through the metering device (56 in heating mode and 58 in cooling mode) and returns to the evaporator (outside coil 50 in heating mode and inside coil 52 in cooling mode) where the process begins again.

In both heating and cooling modes, a motor 70 drives compressor 60 and circulates refrigerant through reversible refrigeration/heating loop 46. The motor may receive power either directly from an AC or DC power source or from a variable speed drive (VSD). The motor may be a switched reluctance (SR) motor, an induction motor, an electronically commutated permanent magnet motor (ECM), or any other suitable motor type.

The operation of motor 70 is controlled by control circuitry 72. Control circuitry 72 receives information from an input device 74 and sensors 76, 78, and 80 and uses the information to control the operation of heat pump system 44 in both cooling mode and heating mode. For example, in cooling mode, input device 74 provides a temperature set point to control circuitry 72. Sensor 80 measures the ambient indoor air temperature and provides it to control circuitry 72. Control circuitry 72 then compares the air temperature to the temperature set point and engages compressor motor 70 and fan motors 64 and 68 to run the cooling system if the air temperature is above the temperature set point. In heating mode, control circuitry 72 compares the air temperature from sensor 80 to the temperature set point from input device 74 and engages motors 64, 68, and 70 to run the heating system if the air temperature is below the temperature set point.

Control circuitry 72 also uses information received from input device 74 to switch heat pump system 44 between heating mode and cooling mode. For example, if input device 74 is set to cooling mode, control circuitry 72 will send a signal to a solenoid 82 to place reversing valve 54 in air conditioning position 84. Consequently, the refrigerant will flow through reversible loop 46 as follows: the refrigerant exits compressor 60, is condensed in outside coil 50, is expanded by metering device 58, and is evaporated by inside coil 52. If the input device is set to heating mode, control circuitry 72 will send a signal to solenoid 82 to place reversing valve 54 in heat pump position 86. Consequently, the refrigerant will flow through the reversible loop 46 as follows: the refrigerant exits compressor 60, is condensed in inside coil 52, is expanded by metering device 56, and is evaporated by outside coil 50.

The control circuitry may execute hardware or software control algorithms to regulate the heat pump system 44. In some embodiments, the control circuitry may include an analog to digital (A/D) converter, a microprocessor, a non-volatile memory, and an interface board.

The control circuitry also may initiate a defrost cycle when the system is operating in heating mode. When the outdoor temperature approaches freezing, moisture in the outside air that is directed over outside coil 50 may condense and freeze on the coil. Sensor 76 measures the outside air temperature, and sensor 78 measures the temperature of outside coil 50. These sensors provide the temperature information to the control circuitry which determines when to initiate a defrost cycle. For example, if either of sensors 76 or 78 provides a temperature below freezing to the control circuitry, system 44 may be placed in defrost mode. In defrost mode, solenoid 82 is actuated to place reversing valve 54 in air conditioning position 84, and motor 64 is shut off to discontinue air flow over the multichannels. System 44 then operates in cooling mode until the increased temperature and pressure refrigerant flowing through outside coil 50 defrosts the coil. Once sensor 78 detects that coil 50 is defrosted, control circuitry 72 returns the reversing valve 54 to heat pump position 86. The defrost cycle can be set to occur at many different time and temperature combinations.

Figure 6:
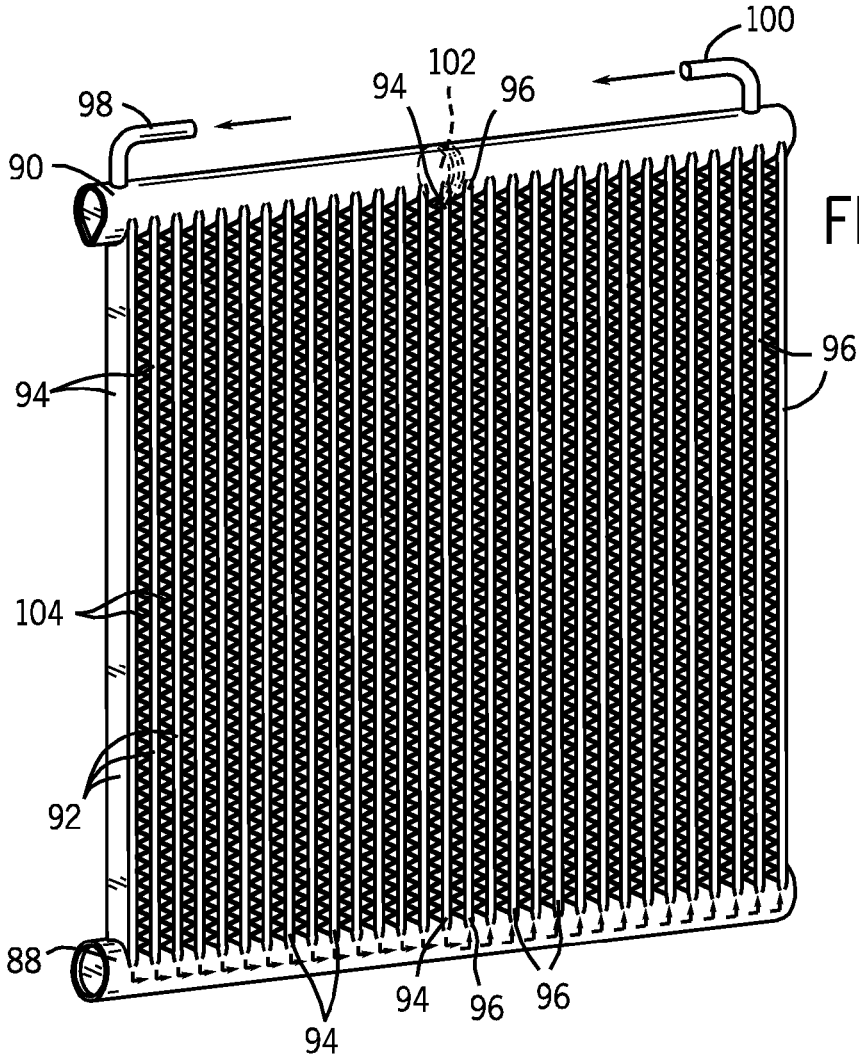
FIG. 6 is a perspective view of an exemplary heat exchanger containing tube and manifold configurations.

FIG. 6 is a perspective view of an exemplary heat exchanger, which may be used in an air conditioning system 10 or a heat pump system 44. The exemplary heat exchanger may be a condenser 16, an evaporator 22, an outside coil 50, or an inside coil 52, as shown in FIGS. 4 and 5. It should also be noted that in similar or other systems, the heat exchanger may be used as part of a chiller or in any other heat exchanging application. The heat exchanger includes a bottom manifold 88 and a top manifold 90 that are connected by multichannel tubes 92. Although 30 tubes are shown in FIG. 6, the number of tubes may vary. The manifolds and tubes may be constructed of aluminum or any other material that promotes good heat transfer. Refrigerant flows from top manifold 90 through first tubes 94 to bottom manifold 88. The refrigerant then returns to top manifold 90 through second tubes 96. In some embodiments, the heat exchanger may be rotated approximately 90 degrees so that the multichannel tubes run horizontally between side manifolds. The heat exchanger may be inclined at an angle relative to the vertical. Furthermore, although the multichannel tubes are depicted as having an oblong shape, the tubes may be any shape, such as tubes with a cross-section in the form of a rectangle, square, circle, oval, ellipse, triangle, trapezoid, or parallelogram. In some embodiments, the tubes may have a diameter ranging from 0.5 mm to 3 mm. It should also be noted that the heat exchanger may be provided in a single plane or slab, or may include bends, corners, contours, and so forth.

Refrigerant enters the heat exchanger through an inlet 98 and exits the heat exchanger through an outlet 100. Although FIG. 6 depicts the inlet and outlet as located on top manifold 90, the inlet and outlet may be located on bottom manifold 90 in other embodiments. The fluid may also enter and exit the manifold from multiple inlets and outlets positioned on bottom, side, or top surfaces of the manifold. Baffles 102 separate the inlet and the outlet portions of the manifold 88. Although a double baffle 102 is illustrated, any number of one or more baffles may be employed to create separation of inlet 98 and outlet 100.

Fins 104 are located between multichannel tubes 92 to promote the transfer of heat between tubes 92 and the environment. In one embodiment, the fins are constructed of aluminum, brazed or otherwise joined to the tubes, and disposed generally perpendicular to the flow of refrigerant. However, in other embodiments the fins may be made of other materials that facilitate heat transfer and may extend parallel or at varying angles with respect to the flow of the refrigerant. The fins may be louvered fins, corrugated fins, or any other suitable type of fin.

In a typical evaporator heat exchanger application, a portion of the heat transfer occurs due to a phase change of the refrigerant. Refrigerant exits the expansion device as a low pressure and temperature liquid and enters the evaporator. As the liquid travels through first multichannel tubes 94, the liquid absorbs heat from the outside environment causing the liquid to warm from its subcooled temperature (i.e., a number of degrees below the boiling point). Then, as the liquid refrigerant travels through second multichannel tubes 96, the liquid absorbs more heat from the outside environment causing it to boil into a vapor. Although evaporator applications typically use liquid refrigerant to absorb heat, some vapor may be present along with the liquid due to the expansion process. The amount of vapor may vary based on the type of refrigerant used. In some embodiments, the refrigerant may contain approximately 15% vapor by weight and 90% vapor by volume. This vapor has a lower density than the liquid, causing the vapor to separate from the liquid within manifold 88. Consequently, certain flow channels of tubes 92 may contain only vapor.

Figure 7:
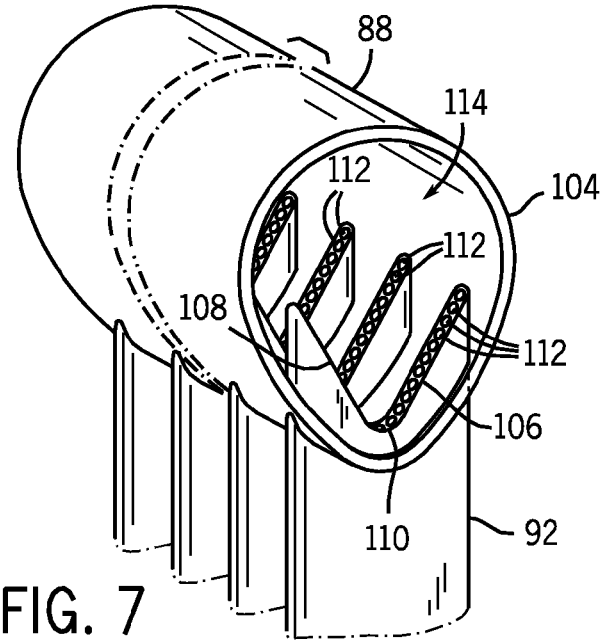
FIG. 7 is a detail perspective view of an exemplary manifold for use in the heat exchanger of FIG. 6.

FIG. 7 is a detail perspective view of top manifold 90 shown in FIG. 6. The manifold includes a teardrop shaped cross-section 104, which promotes collection of vapor phase refrigerant in the top of the manifold and collection of liquid phase refrigerant in the bottom of the manifold. Multichannel tubes 92 have been cut at angles to form a V-shape. A first angle 106 and a second angle 108 meet to form a lower section 110. Although only two angle sections and one lower section are shown in FIG. 7, in other embodiments, a plurality of angle sections may exist to form two or more lower sections.

Flow channels 112 are contained in both the angle and lower sections of the tubes. Refrigerant enters the manifold in both the liquid and vapor phases. The vapor phase collects in an upper interior volume 114. Teardrop shaped cross-section 104 promotes collection of the vapor phase. The liquid phase, on the other hand, collects near lower section 110. Because of the liquid and vapor phase separation within the manifold, the flow channels contained in the lower section of the tubes may contain primarily liquid phase refrigerant while the flow channels contained in the upper angle sections may contain primarily vapor phase refrigerant. As a result, each tube may contain vapor phase refrigerant in some flow channels and liquid phase refrigerant in other flow channels. Although the refrigerant phases are segregated within flow channels, each individual tube contains both phases of refrigerant. This may result in improved heat transfer efficiency across the entire heat exchanger.

Figure 8:
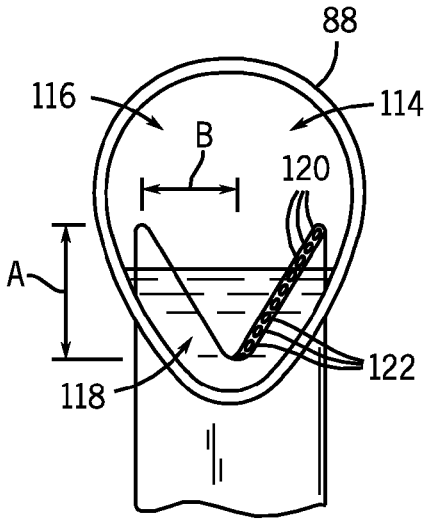
FIG. 8 is a front sectional view of the exemplary manifold of FIG. 7 sectioned through the manifold tube.

FIG. 8 is a front sectional view of manifold 88 shown in FIG. 7 illustrating the separation of the refrigerant phases. Interior volume 114 contains a vapor section 116 and a liquid section 118. The level of the liquid section may vary during operation and may vary based on system properties such as refrigerant charge, environmental temperature, and refrigerant velocity. Vapor section flow channels 120 receive primarily vapor phase refrigerant while liquid section flow channels 122 receive primarily liquid phase refrigerant. However, each individual tube 92 contains both vapor section flow channels 120 and liquid section flow channels 122. A height A of the tubes may be adjusted to vary the number of vapor section tubes and the number of liquid section tubes. A width B of each angled section may be altered to change the depth of liquid section 118.

FIGS. 9-13 illustrate alternate tube and manifold configurations that may be used in the heat exchanger of FIG. 6. Although all the tube and manifold configurations have been depicted in a top manifold position, these configurations may also be employed in bottom or side manifolds. For example, if the configurations are employed in a bottom manifold, the shorter tubes will terminate near the top of the manifold and the longer tubes will extend further into the manifold. Consequently, the vapor phase refrigerant will rise to the top of the manifold and flow through the shorter tubes while the liquid phase refrigerant will collect in the bottom of the manifold and flow through the taller tubes. Any of the manifold cross-sections, such as the teardrop shaped cross-section shown in FIG. 8 or the circular cross-section shown in FIG. 9 described below, may be used with any of the tube configurations shown in FIGS. 7-13. The geometry of the tubes may be varied to change the curvature or angles of the tube ends.

FIG. 9 illustrates an alternate manifold 126 containing an alternate tube configuration. The manifold has a circular cross-section 128. Alternate tubes 130 angle upward to form a point 132 within an interior volume 134. Because the vapor phase refrigerant rises within the manifold, upper flow channels 136 will contain primarily vapor phase refrigerant. Conversely, lower flow channels 138 will contain primarily liquid phase refrigerant.

FIG. 10 illustrates another alternate tube configuration. Alternate tubes 140 have a curved end 142. Upper flow channels 144 will contain primarily vapor phase refrigerant while lower flow channels 146 will contain primarily liquid phase refrigerant.

FIG. 11 illustrates still another alternate tube configuration. Alternate tubes 148 have a curved end 150 with an aperture 152 disposed within each end. Aperture 152 has its own center flow channels 154, which may be connected to main flow channels 156 and 158. The main flow channels include top flow channels 156 and side flow channels 158. The top flow channels 156 may contain primarily vapor phase refrigerant while the side flow channels may contain primarily liquid phase refrigerant. However, the vapor phase refrigerant from top flow channels 156 may flow down into aperture 152 and mix with the liquid phase refrigerant. Therefore, the refrigerant within the center flow channels may contain a mix of liquid and vapor phase refrigerant.

FIG. 12 illustrates another alternate tube configuration. Alternate tubes 160 have an angled end 162 that results in flow channels being located at different heights within the manifold. Top flow channels 164 will contain primarily vapor phase refrigerant while bottom flow channels 166 will contain primarily liquid phase refrigerant.

FIG. 13 depicts an alternate tube configuration that employs tubes of different heights within the manifold. Taller tubes 168 extend farther into the manifold than shorter tubes 170. Taller tubes 168 extend into the manifold at a distance C while shorter tubes 170 extend into the manifold at a distance D. The ratio of distance C to distance D may vary based on the individual properties of the heat exchanger. In other embodiments, tubes may extend at a plurality of distances into the manifold. Although the manifold is shown as alternating shorter tubes and longer tubes, in other embodiments, the tubes may be arranged in other configurations, such as two shorter tubes followed by one taller tube. The tubes also may be arranged in a random configuration.

The liquid phase refrigerant collects in the bottom of the manifold while the vapor phase refrigerant collects near the top of the manifold. Consequently, shorter tubes 170 may contain primarily liquid phase refrigerant 176 while taller tubes 172 may contain primarily vapor phase refrigerant 178. Although some tubes may contain all vapor phase refrigerant while other tubes contain all liquid phase refrigerant, the phases contained in the tubes at different locations within the heat exchanger may be controlled using the tube height.

The manifold configurations described herein may find application in a variety of heat exchangers and HVAC&R systems containing heat exchangers. However, the configurations are particularly well-suited to evaporators used in residential air conditioning and heat pump systems and are intended to provide improved heat exchanger efficiency by directing the flow of liquid and vapor phase refrigerant to specific flow channels.

It should be noted that the present discussion makes use of the term "multichannel" tubes or "multichannel heat exchanger" to refer to arrangements in which heat transfer tubes include a plurality of flow paths between manifolds that distribute flow to and collect flow from the tubes. A number of other terms may be used in the art for similar arrangements. Such alternative terms might include "microchannel" and "microport." The term "microchannel" sometimes carries the connotation of tubes having fluid passages on the order of a micrometer and less. However, in the present context such terms are not intended to have any particular higher or lower dimensional threshold. Rather, the term "multichannel" used to describe and claim embodiments herein is intended to cover all such sizes. Other terms sometimes used in the art include "parallel flow" and "brazed aluminum". However, all such arrangements and structures are intended to be included within the scope of the term "multichannel." In general, such "multichannel" tubes will include flow paths disposed along the width or in a plane of a generally flat, planar tube, although, again, the invention is not intended to be limited to any particular geometry unless otherwise specified in the appended claims.

While only certain features of the invention have been illustrated and described herein, many modifications and changes will occur to those skilled in the art. It is, therefore, to be understood that the appended claims are intended to cover all such modifications and changes as fall within the true spirit of the invention. Furthermore, in an effort to provide a concise description of the exemplary embodiments, all features of an actual implementation may not have been described. It should be appreciated that in the development of any such actual implementation, as in any engineering or design project, numerous implementation specific decisions must be made. Such a development effort might be complex and time consuming, but would nevertheless be a routine undertaking of design, fabrication, and manufacture for those of ordinary skill having the benefit of this disclosure.

The invention claimed is:

1. A heat exchanger comprising:

a first manifold configured to receive a mixed phase flow of liquid and vapor that at least partially separates in the first manifold and comprising a liquid section configured to collect the liquid and a vapor section configured to collect the vapor, wherein the liquid section and the vapor section each extend along a common length of the first manifold to form a continuous interior volume of the first manifold;

a second manifold; and a plurality of multichannel tubes in fluid communication with the first and second manifolds, each of the multichannel tubes having a first end disposed in the first manifold, a second end disposed in the second manifold, and a plurality of flow paths extending between the first and second ends, wherein the first ends extend into the continuous volume of the first manifold to direct liquid phase flow from the liquid section through some of the flow paths and vapor phase flow the vapor section through other flow paths.

2. The heat exchanger of claim 1, wherein at least one of the first ends comprises a generally arcuate profile that positions inlets of outer flow paths within the liquid section and inlets of inner flow paths within the vapor section.

3. The heat exchanger of claim 1, wherein at least one of the first ends comprises an aperture extending through the multichannel tube to produce an inlet to at least one of the flow paths that receives liquid phase flow, and wherein the inlet is disposed within the liquid section.

4. The heat exchanger of claim 1, wherein the first end of at least one of the multichannel tubes extends into the first manifold to position all flow path inlets thereof within the liquid section to receive only liquid phase flow, and wherein the first end of at least one other of the multichannel tubes extends into the first manifold to position all flow path inlets thereof within the vapor section to receive only vapor phase flow.

5. The heat exchanger of claim 1, wherein the first and second manifolds extend generally horizontally, and wherein the plurality of the multichannel tubes are spaced along the common length of the first manifold to align each of the first ends with the liquid section and with the vapor section.

6. The heat exchanger of claim 5, wherein the first manifold is positioned above the second manifold.

7. The heat exchanger of claim 5, wherein the first manifold is positioned below the second manifold.

8. The heat exchanger of claim 1, wherein at least one of the first ends comprises a V-shaped profile having an angled section that positions an inlet of at least one of the flow paths receiving vapor phase flow within the vapor section and having a lower section that positions an inlet of at least one of the flow paths receiving liquid phase flow within the liquid section.

9. The heat exchanger of claim 1, wherein at least one of the first ends comprises an angled profile that positions inlets of the flow paths receiving liquid phase flow within the liquid section and inlets of the flow paths receiving vapor phase flow within the vapor section.

10. A heat exchanger comprising:

a generally horizontal first manifold configured to receive a mixed phase flow of liquid and vapor that at least partially separates in the first manifold and comprising a liquid section configured to collect the liquid and a vapor section configured to collect the vapor, wherein the liquid section and the vapor section each extend along a common length of the first manifold to form a continuous interior volume of the first manifold;

a generally horizontal second manifold; and a plurality of multichannel tubes in fluid communication with the first and second manifolds, each of the multichannel tubes having an inlet end disposed in the first manifold, an outlet end disposed in the second manifold, and a plurality of flow paths extending between the inlet and outlet ends, wherein the plurality of flow paths comprise liquid flow paths and vapor flow paths segregated from one another from the inlet ends to the outlet ends, and wherein each of the inlet ends are configured to position liquid inlets the liquid flow paths within the liquid section to receive liquid phase flow and vapor inlets of the vapor flow paths within the vapor section to receive vapor phase flow such that the liquid and vapor inlets are disposed within the same multichannel tube.

11. The heat exchanger of claim 10, wherein the first manifold is positioned above the second manifold.

12. The heat exchanger of claim 10, wherein the first manifold is positioned below the second manifold.

13. The heat exchanger of claim 10, wherein the inlet ends comprise triangular shaped profiles and wherein the vapor inlets are disposed adjacent to a point of the triangular shaped profiles.

14. The heat exchanger of claim 10, wherein the inlet ends comprises slanted profiles and wherein the vapor inlets and the liquid inlets are disposed on opposite sides of the slanted profiles from one another.

15. A heat exchanger comprising:

a generally horizontal first manifold configured to receive a mixed phase flow of liquid and vapor that at least partially separates within the first manifold and comprising an upper section configured to collect the vapor and a lower section configured to collect the liquid, wherein the upper section and the lower section each extend along a common length of the first manifold to form a continuous interior volume within the first manifold;

a generally horizontal second manifold; and a plurality of multichannel tubes in fluid communication with the first and second manifolds, each of the multichannel tubes having a first end disposed in the first manifold, a second end disposed in the second manifold, and a plurality of flow paths extending between the first and second ends, wherein the first ends are disposed within the continuous interior volume such that at least some of the flow paths terminate within the upper section to direct the vapor through the multichannel tubes in operation and such that at least other of the flow paths terminate within the lower section to direct the liquid through the multichannel tubes in operation.

16. The heat exchanger of claim 15, wherein the upper section and the lower section are separated in operation by a liquid-vapor boundary between the liquid and the vapor, and wherein at least one of the first ends is positioned across the liquid-vapor boundary to position vapor inlets of the vapor flow paths within the upper section and liquid inlets of the liquid flow paths within the liquid section.

17. The heat exchanger of claim 15, wherein all of the flow paths of at least one of the multichannel tubes terminate within the upper section and wherein all of the flow paths of at least another one of the multichannel tubes terminate within the lower section.

18. The heat exchanger of claim 15, wherein at least one of the multichannel tubes has an end that extends into the first manifold at a first distance into the first manifold and wherein at least another of the multichannel tubes has an end that extends into the first manifold at a second distance into the first manifold different than the first distance.

* * * * *